US011357308B1

(12) United States Patent
Liu

(10) Patent No.: US 11,357,308 B1
(45) Date of Patent: Jun. 14, 2022

(54) LIPSTICK CONTAINER WITH REPLACEABLE LIPSTICK TUBE

(71) Applicant: Ting Nan Liu, New Taipei (TW)

(72) Inventor: Ting Nan Liu, New Taipei (TW)

(73) Assignee: Zhuhai Ding Rong Plastic Products Co., LTD., Zhuhai (CN)

( * ) Notice: Subject to any disclaimer, the term of this patent is extended or adjusted under 35 U.S.C. 154(b) by 0 days.

(21) Appl. No.: 17/193,045

(22) Filed: Mar. 5, 2021

(51) Int. Cl.

| | |
|---|---|
| ***B43K 21/027*** | (2006.01) |
| ***A45D 40/00*** | (2006.01) |
| ***A45D 40/12*** | (2006.01) |
| ***A45D 40/02*** | (2006.01) |

(52) U.S. Cl.
CPC ..... *A45D 40/00* (2013.01); *A45D 40/02* (2013.01); *A45D 40/12* (2013.01); *A45D 2040/005* (2013.01); *A45D 2040/0043* (2013.01); *A45D 2040/0062* (2013.01)

(58) Field of Classification Search
CPC . A45D 40/02; A45D 40/12; A45D 2040/0043
USPC ..... 401/55
See application file for complete search history.

(56) References Cited

U.S. PATENT DOCUMENTS

| | | | | |
|---|---|---|---|---|
| 5,399,040 | A * | 3/1995 | Holloway | A45D 40/06 401/78 |
| 5,649,777 | A * | 7/1997 | Holloway | A45D 40/06 401/74 |
| 8,132,977 | B2 * | 3/2012 | Pires | A45D 40/06 401/88 |
| 11,129,463 | B2 * | 9/2021 | Dinata | A45D 40/12 |
| 2021/0068518 | A1 * | 3/2021 | Genelot | A45D 40/12 |

* cited by examiner

*Primary Examiner* — Jennifer C Chiang

(57) ABSTRACT

A lipstick container includes a cap including a plurality of cavities on an inner surface; a lipstick tube including a locking hole in a bottom, two opposite recesses on the locking hole, and a projection on an inner surface of the locking hole and distal the recesses; a carriage put on an outer surface of the lipstick tube adjacent to the locking hole and including a plurality of protrusions on an outer surface and complementarily disposed in the cavities respectively, an axial channel, and an annular protuberance on a surface of the axial channel, and a plurality of slits in the annular protuberance; and a seat including a bossed hole extending to dispose in both the axial channel and the locking hole, and two opposite tabs formed on an edge of the bossed hole and passing through the recesses respectively to urge against the projection.

5 Claims, 5 Drawing Sheets

LIPSTICK CONTAINER WITH REPLACEABLE LIPSTICK TUBE

BACKGROUND OF THE INVENTION

1. Field of the Invention

The invention relates to cosmetic containers and more particularly to a lipstick container having a replaceable lipstick tube.

2. Description of Related Art

Lipstick is a cosmetic that applies color, texture, and protection to the lips. Some lipsticks are also lip balms, to add both color and hydration. In use, a person removes a cap from a lipstick container, clockwise turns the lipstick tube until the lipstick is exposed, and applies lipstick to the lips. After use, the person counterclockwise turns the lipstick tube until the lipstick is retracted into the lipstick tube, and returns the cap to its original position to close the lipstick container.

However, conventional lipstick containers are disposed after the contained lipstick is consumed. This not only pollutes the environment but also is not eco-friendly.

Thus, the need for improvement still exists.

SUMMARY OF THE INVENTION

It is therefore one object of the invention to provide a lipstick container comprising a cap including a plurality of cavities on an inner surface; a lipstick tube including a locking hole in a bottom, two opposite recesses on the locking hole, and a projection on an inner surface of the locking hole and distal the recesses; a carriage put on an outer surface of the lipstick tube adjacent to the locking hole and including a plurality of protrusions on an outer surface and complementarily disposed in the cavities respectively, an axial channel, and an annular protuberance on a surface of the axial channel, and a plurality of slits in the annular protuberance; and a seat including a bossed hole extending to dispose in both the axial channel and the locking hole, and two opposite tabs formed on an edge of the bossed hole and passing through the recesses respectively to urge against the projection; wherein a distance from one tab to the other tab is less than a distance from one recess to the other recess and greater than a diameter of the locking hole.

The invention has the following advantages and benefits in comparison with the conventional art:

Convenience and eco-friendly. The seat can be removed from both the carriage and the lipstick tube by turning the seat to dispose the tabs in the recesses. A person may replace a consumed lipstick with a new one and thus the lipstick container can be reused. This not only protects the environment but also is eco-friendly with reduced waste.

Increased stability. After the bossed hole has passed through the axial channel and the locking hole and been locked, both the carriage and the lipstick tube are positioned by the bossed hole, thereby fastening the seat, the carriage and the lipstick tube together.

The above and other objects, features and advantages of the invention will become apparent from the following detailed description taken with the accompanying drawings.

DETAILED DESCRIPTION OF THE INVENTION

Figure 1:
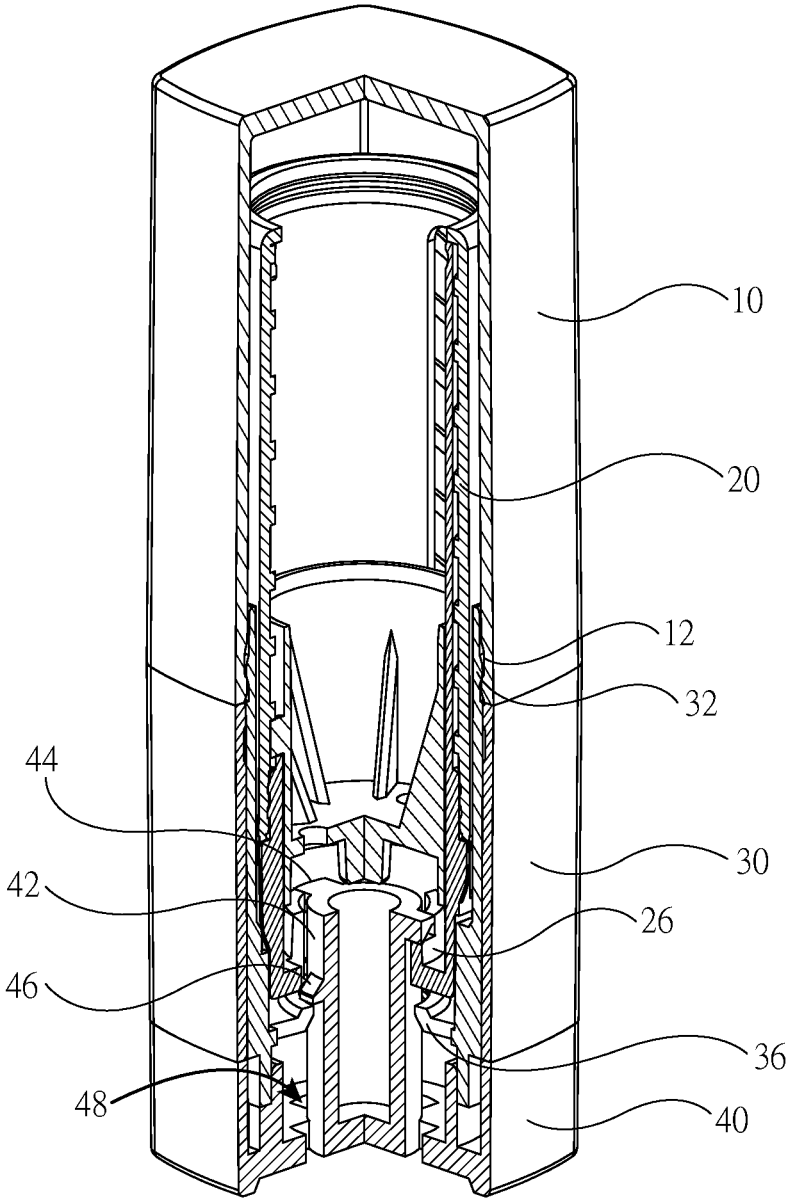
FIG. 1 is a broken away longitudinal sectional view of a lipstick container according to the invention.

Referring to FIGS. 1 to 5, a lipstick container in accordance with the invention comprises a cap 10, a lipstick tube 20, a carriage 30 and a seat 40 as discussed in detail below.

The cap 10 includes four elongated cavities 12 on an inner surface proximate the mouth. The lipstick tube 20 includes a locking hole 22 in a bottom, two opposite recesses 24 on the mouth of the locking hole 22, and a projection 26 on an inner surface of the locking hole 22 and distal the recesses 24. The carriage 30 is put on a lower portion of the lipstick tube 20 and includes four protrusions 32 on an outer surface proximate the top and complementarily disposed in the cavities 12 respectively, an axial channel 34, an annular protuberance 36 on a surface of the axial channel 34, and four spaced slits 361 formed in the annular protuberance 36. The seat 40 includes four vent holes 48 in a bottom for exiting air so that the carriage 30 can be releasably secured to the seat 40. The seat 40 further comprises a bossed hole 42 extending upward from a center to dispose in both the axial channel 34 and the locking hole 22, and two opposite tabs 44 formed on the top edge of the bossed hole 42 and urging against the projection after passing through the recesses 24 respectively, a distance from one tab 44 to the other tab 44 being less than a distance from one recess 24 to the other recess 24 but greater than a diameter of the locking hole 22. The seat 40 further comprises at least one projecting member 46 on an intermediate portion of an outer surface of the bossed hole 42 and urging against the annular protuberance 36. After the bossed hole 42 has passed through the axial channel 34 and the locking hole 22 and been locked, both the carriage 30 and the lipstick tube 20 are positioned by the bossed hole 42, thereby fastening the seat 40, the carriage 30 and the lipstick tube 20 together.

The slits 361 are tapered toward the axial channel 34 and are used to facilitate the bossed hole 42 to pass through the axial channel 34 and in turn facilitate the fastening of the seat 40 and the carriage 30.

Figure 3:
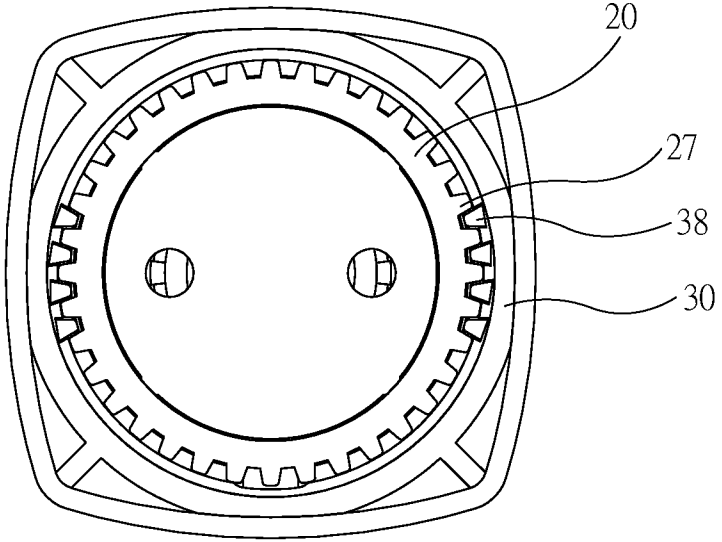
FIG. 3 is a sectional view taken along line 3-3 of FIG. 2.
Figure 2:
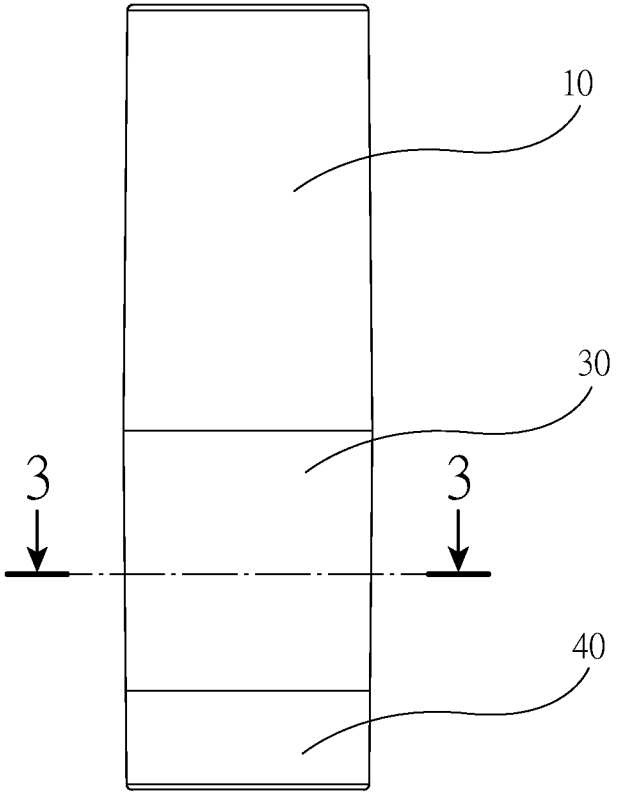
FIG. 2 is a side elevation of the lipstick container.

As shown in FIGS. 1 to 3 specifically, the lipstick tube 30 further comprises a plurality of longitudinal ridges 27 proximate the bottom and the carriage 30 further comprises a plurality of wells 38 on an inner surface configured to complementarily receive the longitudinal ridges 27. This arrangement further increases the stability of the fastened lipstick tube 20 and the carriage 30.

Referring to FIGS. 6 to 10 in conjunction with FIG. 4, a replacement of a consumed lipstick with a new lipstick is discussed below. First, a person may remove the cap 10 from the carriage 30 to expose a consumed lipstick 51 in the lipstick tube 20. Next, the person may clockwise rotate the seat 40 about 90 degrees with the tabs 44 also rotating about 90 degrees. As a result, the tabs 44 urge against the projection 26.

Figures 4, 5:
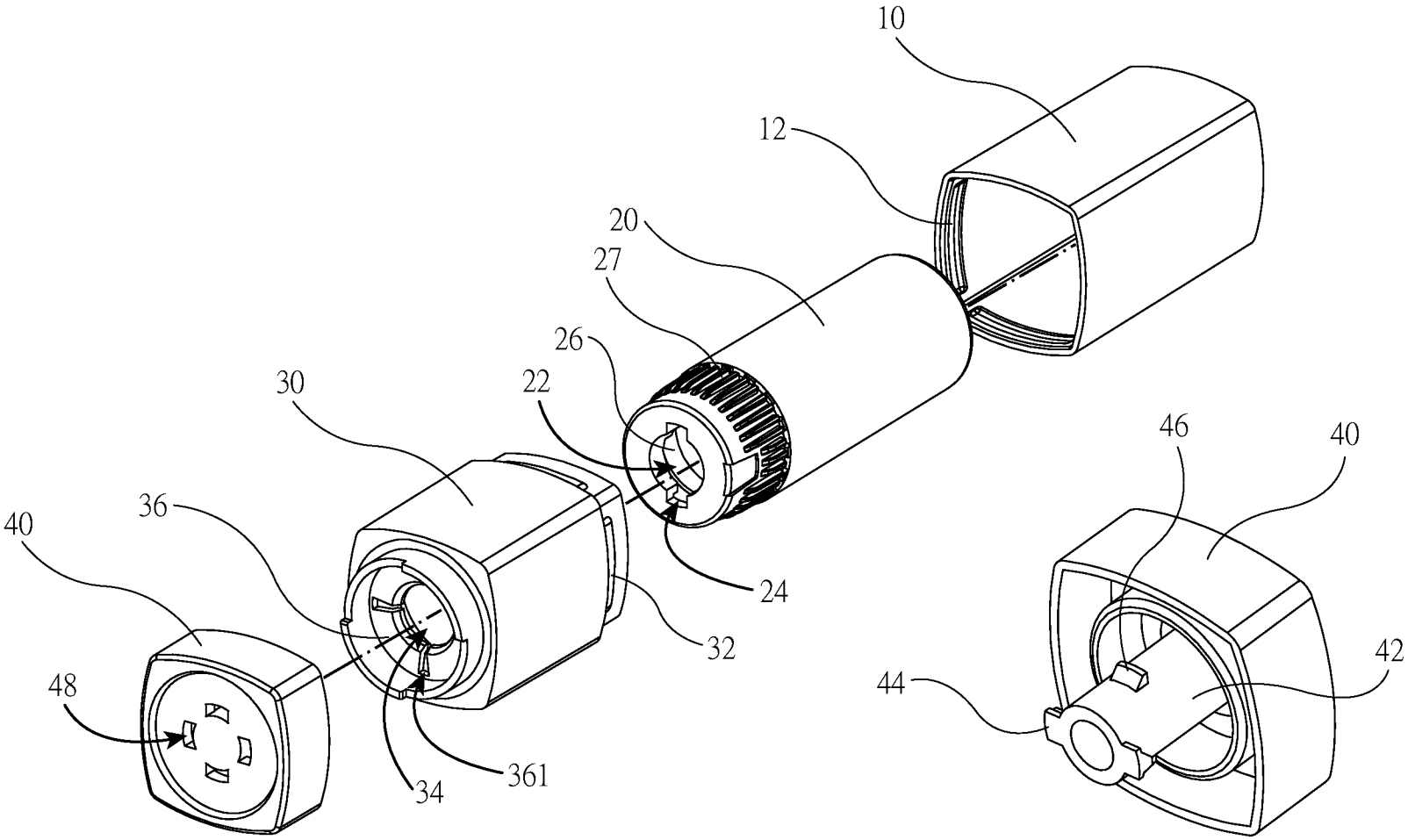
FIG. 4 is an exploded view of the lipstick container.
FIG. 5 is a perspective view of the seat viewed from another angle.
Figures 6, 7, 8:
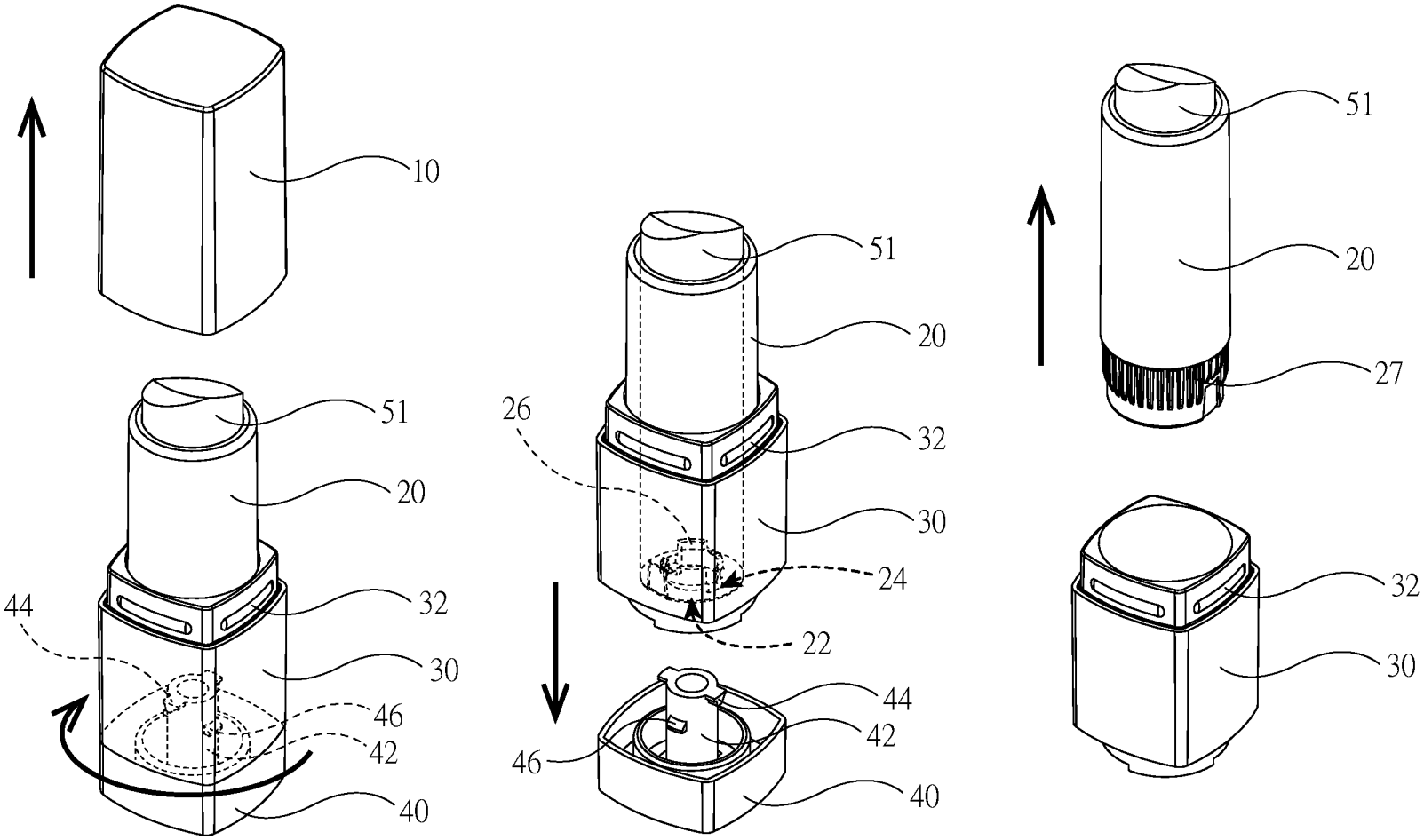
FIG. 6 schematically depicts a removal of the cap and a subsequent clockwise turning of the seat.
FIG. 7 schematically depicts a removal of the seat.
FIG. 8 schematically depicts a removal of the lipstick tube.

As shown in FIG. 7 in conjunction with FIG. 4, after the tabs 44 have been disposed the recesses 24, the person may remove the seat 40 from the locking hole 22 and the axial channel 34.

As shown in FIG. 8, the person may remove the lipstick tube 20 from the carriage 30 by pulling lipstick tube 20 upward.

Figure 9:
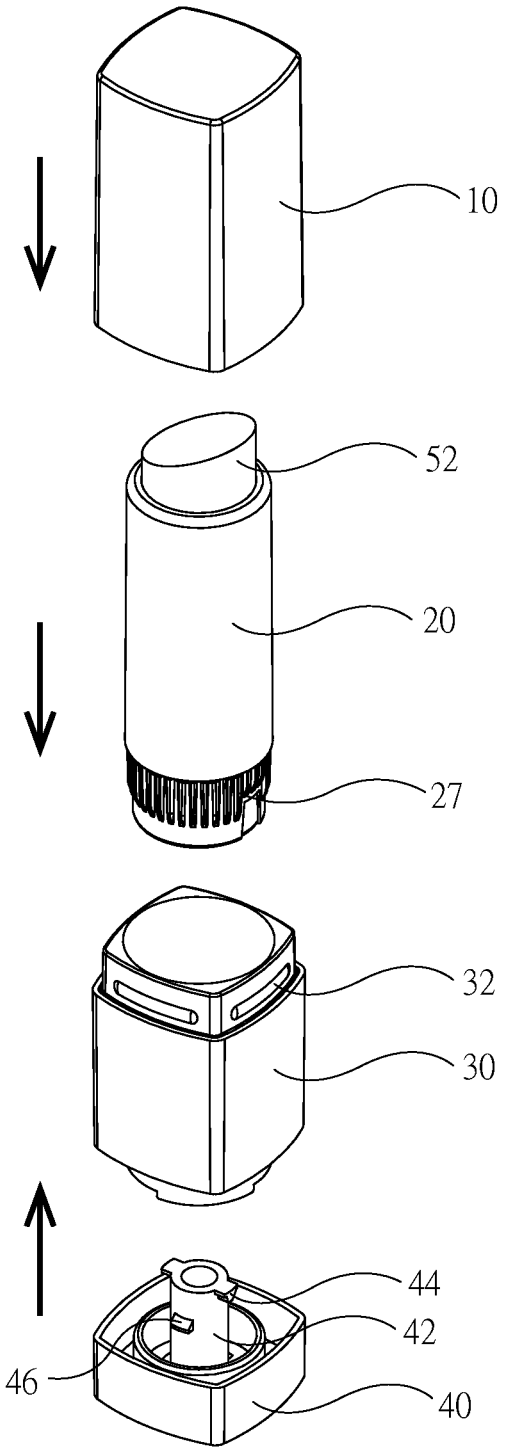
FIG. 9 schematically depicts assembling steps of the lipstick container after a consumed lipstick has been replaced a new lipstick.
Figure 10:
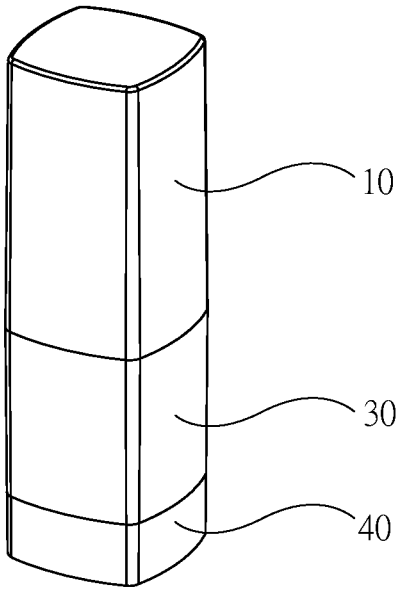
FIG. 10 is a perspective view of the assembled lipstick container.

As shown in FIGS. 9 and 10 in conjunction with FIG. 4, after a new lipstick 52 has been mounted in another lipstick tube 20 and the another lipstick tube 20 and the carriage 30 have been joined, the person may pass the bossed hole 42 through the axial channel 34 and the locking hole 22, rotate the seat 40 to urge the tabs 44 against the projection 26, and put the cap 10 on the carriage 30. This finishes the replacement of the new lipstick 52.

It is envisaged by the invention that the lipstick container can be reused with only the consumed lipstick replaced with a new one. This not only protects the environment but also is eco-friendly with reduced waste in addition to the production cost reduction. The cap 10, the lipstick tube 20, the carriage 30 and the seat 40 are made of polyethylene terephthalate (PET) which is reusable, i.e., eco-friendly. Therefore, the cap 10, the lipstick tube 20, the carriage 30 and the seat 40 are reusable and the environment is protected.

While the invention has been described in terms of preferred embodiments, those skilled in the art will recognize that the invention can be practiced with modifications within the spirit and scope of the appended claims.

What is claimed is:

1. A lipstick container, comprising:

a cap including a plurality of cavities on an inner surface;

a lipstick tube including a locking hole in a bottom, two opposite recesses on the locking hole, and a projection on an inner surface of the locking hole and distal the recesses;

a carriage put on an outer surface of the lipstick tube adjacent to the locking hole and including a plurality of protrusions on an outer surface and complementarily disposed in the cavities respectively, an axial channel, and an annular protuberance on a surface of the axial channel, and a plurality of slits in the annular protuberance; and a seat including a bossed hole extending to dispose in both the axial channel and the locking hole, and two opposite tabs formed on an edge of the bossed hole and passing through the recesses respectively to urge against the projection;

wherein a distance from one tab to the other tab is less than a distance from one recess to the other recess and greater than a diameter of the locking hole.

2. The lipstick container of claim 1, wherein the lipstick tube further comprises a plurality of longitudinal ridges and the carriage further comprises a plurality of wells on an inner surface configured to complementarily receive the longitudinal ridges.

3. The lipstick container of claim 1, wherein the seat further comprises at least one projecting member on an intermediate portion of an outer surface of the bossed hole and urging against the annular protuberance.

4. The lipstick container of claim 1, wherein the seat further comprises a plurality of vent holes.

5. The lipstick container of claim 1, wherein the slits are tapered toward the axial channel.

* * * * *